US008434503B2

(12) United States Patent
Kim

(10) Patent No.: US 8,434,503 B2
(45) Date of Patent: May 7, 2013

(54) DISHWASHER

(75) Inventor: Min Chul Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 960 days.

(21) Appl. No.: 12/501,773

(22) Filed: Jul. 13, 2009

(65) Prior Publication Data

US 2010/0006125 A1 Jan. 14, 2010

(30) Foreign Application Priority Data

Jul. 14, 2008 (KR) ..... 10-2008-0067941

(51) Int. Cl.
*B08B 3/00* (2006.01)

(52) U.S. Cl.
USPC ..... 134/111; 134/56 R; 134/57 R; 134/57 D

(58) Field of Classification Search ..... 134/56 D, 134/57 D
See application file for complete search history.

(56) References Cited

U.S. PATENT DOCUMENTS

2005/0263174 A1 12/2005 Yoon et al.
2006/0130878 A1 6/2006 Lee et al.

FOREIGN PATENT DOCUMENTS

KR 10-0606823 7/2006

OTHER PUBLICATIONS

French Search Report dated Jan. 11, 2012.
Korean Office Action dated Apr. 9, 2010.

*Primary Examiner* — Michael Barr
*Assistant Examiner* — Jason Ko
(74) *Attorney, Agent, or Firm* — Ked & Associates LLP

(57) ABSTRACT

A dishwasher is provided, which can prevent deformation of a filter due to water pressure from occurring, even if the filter is stopped up with dirt. The dishwasher includes a sump that stores washing water, a drainage chamber provided at a side of the sump and linked with a drainage pump, a dirt chamber including a collection pipe that supplies the washing water of the drainage chamber to a dirt storage device, a filter provided above the dirt storage device, that filters the washing water, and a bypass path that links the drainage chamber with the sump, provided to pass through a position higher than the filter.

19 Claims, 3 Drawing Sheets

DISHWASHER

This application claims the benefit of the Korean Patent Application No. 10-2008-0067941, filed on Jul. 14, 2008, which is hereby incorporated by reference as if fully set forth herein.

BACKGROUND OF THE INVENTION

1. Field of the Invention

The present invention relates to a dishwasher.

2. Discussion of the Related Art

A dishwasher is to wash dishes, bowls, spoons, chopsticks, etc., which are used to eat food.

The dishwasher washes dirt by collecting washing objects such as tableware inside a tub constituting appearance and then spraying washing water including detergent into the tableware.

Also, the dishwasher circulates the washing water using a circulating pump, and for saving of the washing water, a filter is provided at a circulating path of the washing water to filter the washing water.

As much dirt is included in the washing water, if the washing water reaches a level not suitable for washing, the washing water is drained out and then resupplied for washing.

However, the aforementioned dishwasher has several problems.

Since the dishwasher repeats drainage and resupply of the washing water, even though the clean washing water is periodically supplied to the dishwasher, if the filter is stopped up with dirt before the water is resupplied, a problem occurs in that it is impossible to filter the washing water.

Also, if the filter is stopped up with dirt, since the circulating pump circulates the washing water at the higher water pressure, a problem occurs in that deformation of the filter may be caused.

SUMMARY OF THE INVENTION

Accordingly, the present invention is directed to a dishwasher that substantially obviates one or more problems due to limitations and disadvantages of the related art.

An object of the present invention is to provide a dishwasher that includes a filtering unit having excellent filtering performance of washing water.

Another object of the present invention is to provide a dishwasher that can prevent deformation of a filtering unit due to water pressure from occurring even if the filtering unit is stopped up with dirt.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a dishwasher according to the present invention comprises a sump for storing washing water; a drainage chamber provided at a side of the sump and linked with a drainage pump; a dirt chamber including a main path supplying the washing water supplied from the sump to spray arms, a sub path supplying some of the washing water supplied from the sump to the drainage chamber, a dirt storage unit storing the washing water passed through the drainage chamber, and a collection pipe supplying the washing water of the drainage chamber to the dirt storage unit; a filter provided above the dirt storage unit, filtering the washing water; and a bypass path linking the drainage chamber with the sump, provided to pass through a position higher than the filter.

In this case, the bypass path includes an inlet provided on the bottom of the drainage chamber. The inlet of the bypass path is protruded from the bottom of the drainage chamber at a predetermined height.

Also, the dishwasher further comprises a connection pipe linked to the end of the sub path and located inside the drainage chamber.

In this case, the dishwasher further comprises a path bending unit provided between an outlet of the connection pipe and the inlet of the bypass path, allowing dirt drained from the connection pipe to be precipitated away from the inlet of the bypass path.

Also, the connection pipe is bent to allow the drained dirt to be precipitated away from the inlet of the bypass path.

Meanwhile, the bypass path further includes a bypass filter for filtering washing water.

Also, the pump is linked to the side of the sump.

Meanwhile, the bypass path includes an inlet provided at a sidewall of the drainage chamber. The inlet of the bypass path is spaced apart from the bottom of the drainage chamber at a predetermined height.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
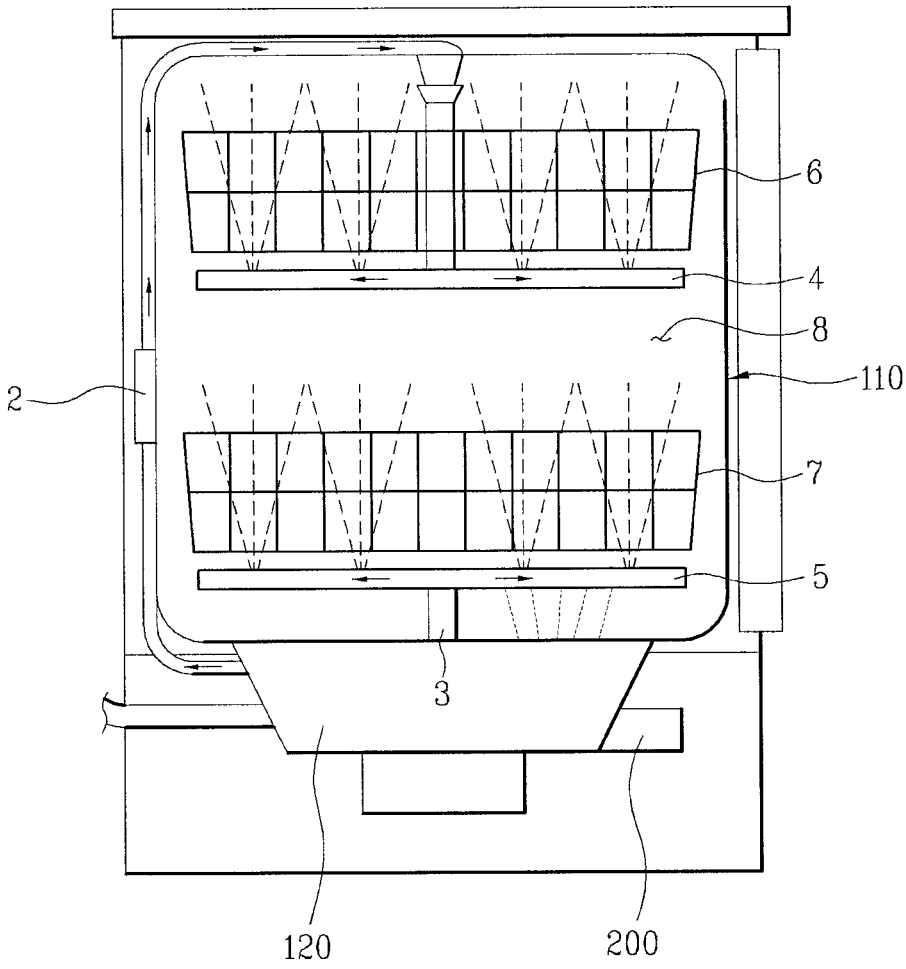
FIG. 1 is a conceptional view illustrating a dishwasher according to the present invention.

Reference will now be made in detail to the preferred embodiments of the present invention, examples of which are illustrated in the accompanying drawings. Wherever possible, the same reference numbers will be used throughout the drawings to refer to the same or like parts.

First of all, a structure of a dishwasher according to one embodiment of the present invention will be described with reference to FIG. 1.

The dishwasher according to the present invention includes a tub 110 provided with a receiving space 8 in which the dishes are received, a sump 120 provided below the tub 110 to store washing water, a circulating pump 200 circulating the washing water stored in the sump 120, upper and lower racks 6 and 7 provided in the tub 110 to receive the dishes therein, upper and lower spray arms 4 and 5 provided above the sump 120 to spray the washing water supplied from the circulating pump 200 to the upper and lower racks 6 and 7, and guide pipes 2 and 3 supplying the washing water pumped from the circulating pump 200 to the upper spray arm 4 and the lower spray arm 5.

The tub 110 forms appearance of the dishwasher, and the receiving space 8 can be selectively opening and closing by a door.

The sump 120 is provided inside the tub 110, and the washing water for washing the dishes is stored in the sump 120.

The sump 120 is provided with a path and a filtering unit therein, wherein the path is to circulate the washing water and the filtering unit is to filter dirt. The path and the filtering unit will later be described in detail.

The circulating pump 200 is linked to a side of the sump 120 and supplies the washing water stored in the sump 120 to the upper and lower spray arms 4 and 5 through the guide pipes 2 and 3.

The upper and lower spray arms 4 and 5 spray the washing water, which flows from the guide pipes 2 and 3, from the lower parts of the racks in which the dishes are received.

The upper and lower spray arms 4 and 5 may be provided above the racks.

Hereinafter, the linkage relation between the tub 110 and the sump 120 will be described.

The tub 110 includes a base 100 constituting the bottom of the dishwasher, and a tub lower plate 112 linked to an upper part of the base 100.

The tub lower plate 112 includes a hole 111 into which the sump 120 can be inserted. A sealing member 115 can be provided between the hole 111 and the sump 120.

The sealing member 115 prevents the washing water of the tub lower plate 112 from flowing to the base 100.

Meanwhile, if the tub lower plate 112 is linked to the base 100, a space of a predetermined size is formed below the tub lower plate 112.

Accordingly, a circumferential surface on the sump 120 is supported by the hole 111, and the lower end of the sump 120 is located in a space between the base 100 and the tub lower plate 112.

Hereinafter, the sump 120 and other elements linked to the sump 120 will be described.

The sump 120 includes a water storage unit 128 storing the washing water, a supply hole 121 connected to the circulating pump 200, and a control valve receiving groove 122 for receiving a control valve 173.

The supply hole 121 is connected with a sump inlet 126 of the circulating pump 200 to flow the washing water supplied from the circulating pump 200 into a washing water inlet 171 of a dirt chamber 170.

Some of the washing water stored in the storage unit 128 is supplied to the upper and lower spray arms 4 and 5 by the circulating pump 200 while the other washing water is collected in the water storage unit 128 through a collecting hole 182 of a filter frame 180 after passing through the dirt chamber 170 and the filtering unit 190.

The water storage unit 128 may be provided with a heater assembly H. The heater assembly H can improve washing efficiency by using heated washing water when washing the dishes.

Figure 2:
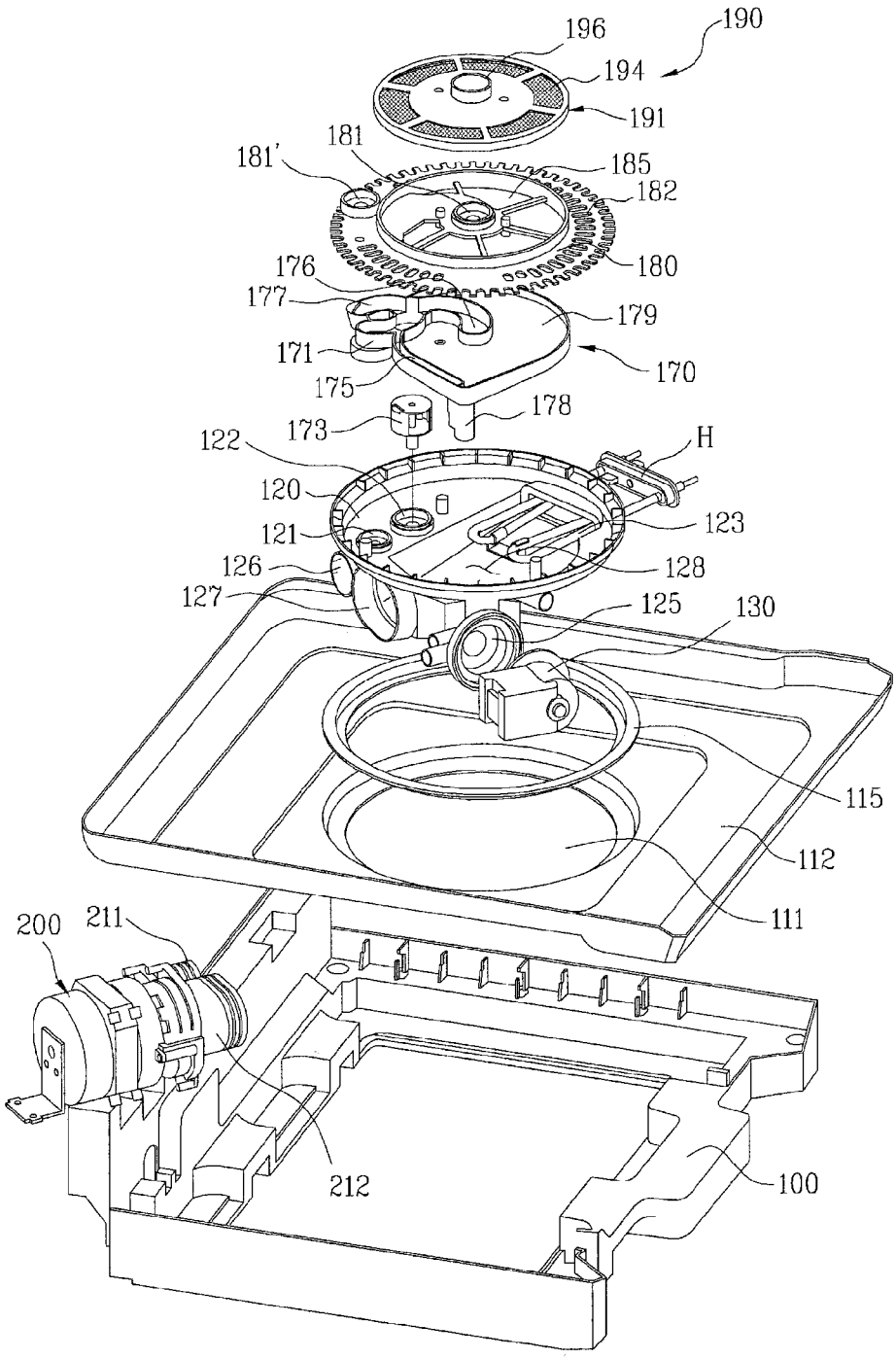
FIG. 2 is an exploded perspective view illustrating a dishwasher according to the present invention.

Although the heater assembly H can be linked to the sump 120 by various manners, the circumferential surface of the sump 120 is linked to the water storage unit 128 in FIG. 2. Namely, the heater assembly H can be inserted into the water storage unit 128 through the circumferential surface of the sump 120.

Meanwhile, a sump inlet 126 and a connector 127, which are connected with the circulating pump 200, and a drainage chamber 125 are provided at one side of the sump 120.

The circulating pump 200 is linked to the circumferential surface of the sump 120 and allows the washing water stored in the water storage unit 128 to flow into the dirt chamber 170.

Accordingly, the washing water stored in the water storage unit 128 flows into a pump inlet 212 through the connector 127, and the washing water flown to the circulating pump 200 flows into the sump inlet 126 through a pump outlet 211.

The washing water flown into the sump inlet 126 is supplied to the dirt chamber 170 through the supply hole 121 and the washing water inlet 171.

A drainage pump 130 that drains out the washing water stored in the water storage unit 128 is linked to the drainage chamber 125. The drainage chamber 125 is not only a space to connect the drainage pump 130 but also a space to store dirt included in the washing water. Namely, the dirt included in the washing water is precipitated in the drainage chamber 125 by its own weight while the washing water flown into the drainage chamber 125 through the sub path 175 flows into the dirt storage unit 179 through the collection pipe 178.

Figure 3:
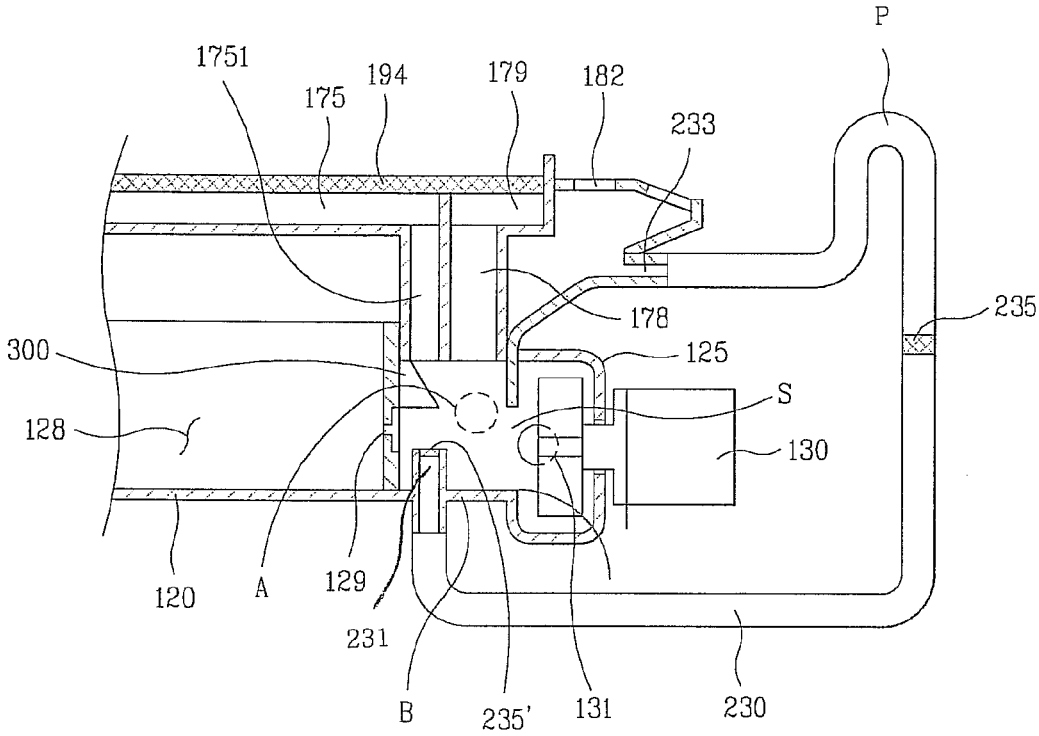
FIG. 3 is an enlarged view illustrating a drainage chamber of a dishwasher according to the present invention.

The drainage chamber 125 has a predetermined volume, and is connected with the water storage unit 128 through a check valve 129 (see FIG. 3). Accordingly, if the drainage pump 130 is actuated, the check valve 129 is opened toward the drainage pump 130 to drain out the washing water, which is stored in the water storage unit 128, through the drainage hole 131.

Accordingly, the circulating pump 200 and the drainage pump 130 are located in a space formed by the tub lower plate 112 and the base 100, and are linked to the circumferential surface of the sump 120.

In this case, if the pumps 200 and 130 are provided on the bottom of the sump 120, it is effective in that the whole size of the dishwasher can be reduced.

Meanwhile, the dirt chamber 170 with an opened upper side is linked to the upper part of the sump 120.

The dirt chamber 170 includes a washing water inlet 171 connected with the supply hole 121 of the sump, a main path supplying the washing water supplied to the washing water inlet 171 to the spray arms, and a sub path 175 and a dirt storage unit 179.

The main path is to supply the washing water supplied from the washing water inlet 171 to the upper and lower spray arms 4 and 5.

In other words, a spray path 177 connected with the upper spray arm 4 and a spray path 176 connected with the lower spray arm 5 can be forked from the main path.

Meanwhile, a hole (not shown) into which a control valve 173 located in the control valve receiving groove 122 is inserted is provided at the fork of the main path.

Accordingly, the control valve 173 is rotatably supported in the control valve receiving groove 122 and is located in the fork of the spray paths 176 and 177.

The control valve 173 selectively supplies the washing water flown into the washing water inlet 171 to the spray path 177 connected with the upper spray arm 4 or the spray path 176 connected with the lower spray arm 5.

Various valves that can be selected by those skilled in the art can be used as the control valve for implementing the aforementioned function. Accordingly, the detailed description of the control valve will be omitted.

However, it is to be understood that the control valve 173 does not exclude a structure that the washing water can be supplied to the spray paths 175 and 177 simultaneously.

The sub path 175 guides some of the washing water supplied to the washing water inlet 171 to the drainage chamber 125.

Meanwhile, it is preferable that some of the washing water flown into the washing water inlet 171 is supplied to the sub path 175 regardless of the control valve 173.

Accordingly, it is preferable that the control valve 173 is provided between the washing water inlet 171 and the fork of the spray paths 176 and 177 while the sub path 175 is provided between the washing water inlet 171 and the control valve 173.

Referring to FIG. 3, the sub path 175 is extended from the washing water inlet 171 to the drainage chamber 125 along the upper part of the dirt chamber 170, and includes a connection pipe 1751 at the end, wherein the connection pipe 1751 is connected with the drainage chamber 125.

The dirt chamber 170 further includes a collection pipe 178 at the bottom, wherein the collection pipe 178 flows the washing water supplied to the drainage chamber 125 through the sub path 175 into the dirt storage unit 179.

Since the washing water flown into the drainage chamber 125 through the sub path 175 flows into the dirt storage unit 179 through the collection pipe 178, the dirt included in the washing water is precipitated by its own weight.

Accordingly, the sub path 175, the drainage chamber 125 and the collection pipe 178 serve to primarily filter the washing water.

The dirt storage unit 179 is provided separately from the spray paths 176 and 177 and the sub path 175. The washing water flows into the dirt storage unit 179 through the collection pipe 178.

Since a filter 194, which will be described later, is located above the dirt storage unit 179, the washing water flown into the collection pipe 178 is collected into the water storage unit 128 of the sump 120 through the collecting hole 182 after passing through the filter 194.

Meanwhile, since the dirt filtered by the filter 194 is stored in the dirt storage unit 179, the dishwasher according to the present invention can secondarily filter the washing water through the dirt storage unit 179 and the filter 194.

A filter frame 180 having a through hole 185 is linked to the upper part of the dirt storage unit 179, and a filter housing 191 having the filter 194 is located above the through hole 185.

Accordingly, the dirt included in the washing water flown into the dirt storage unit 179 is stored in the dirt storage unit 179 by the filter 194 when the filter 194 is overflowing.

Meanwhile, the washing water which has passed through the filter 194 is collected in the water storage unit 128 of the sump 120 through the collecting hole 182 of the filter frame 180, the dishwasher according to the present invention can supply only the filtered washing water to the spray arms 4 and 5.

Hereinafter, the filtering unit 190 linked to the upper part of the dirt chamber 170 will be described with reference to FIG. 2.

The filtering unit 190 supplies the washing water, which is flown into the spray paths 176 and 177 of the dirt chamber 170, to the upper and lower spray arms 4 and 5, and filters the washing water supplied to the dirt storage unit 179.

The filtering unit 190 includes the filter frame 180 provided to correspond to the dirt storage unit 179 and the filter housing 191 linked to the upper part of the through hole 185 of the filter frame 180.

The filter frame 180 includes spray holes 181' and 181 respectively connected with the spray paths 177 and 176, wherein the spray holes 181' and 181 are respectively connected with the guide pipe 2 (see FIG. 1) and a support member 196.

Also, the filter frame 180 includes a through hole 185 provided to correspond to the dirt storage unit 179, and may further include a plurality of collecting holes 182 outside the through hole 185.

The through hole 185 allows the washing water flown into the dirt storage unit 179 to flow to the filter 194 which will be described later.

Meanwhile, it is preferable that a plurality of collecting holes 182 are provided on the circumference of the filter frame 180 to allow the washing water to be collected in the sump 120 after passing through the filter 194 of the filter housing 191. Also, it is preferable that the collecting holes 182 are located between the circumference of the sump 120 and the circumference of the dirt chamber 170.

The filter housing 191 is linked to the upper part of the filter frame 180, and includes a support member 196 connected with the spray hole 181 and the filter 194 connected with the through hole 185.

The support member 196 is connected with the lower guide pipe 3 of FIG. 1 to supply the washing water to the lower spray arm.

The filter 194 is linked to the upper part of the through hole 185, and filters the dirt included in the washing water when the washing water flown into the dirt storage unit 179 overflows.

In case of the aforementioned dishwasher, if the dirt stored in the dirt storage unit 179 increases, the filter 194 is stopped up with the dirt, whereby there is difficulty in that the washing water flows into the water storage unit 128 of the sump 120 through the filter 194 and the collecting holes 182.

If the washing water collected in the water storage unit 128 after passing through the filter 194 decreases, the dirt included in the washing water stored in the water storage unit 128 increases. In this case, a problem occurs in that washing performance of the dishwasher is deteriorated.

Also, the increased pressure inside the dirt chamber 170 may deform the filter 194.

Accordingly, the dishwasher according to the present invention further includes a bypass path 230 provided with an inlet 231 and an outlet 233, wherein the inlet 231 is connected with the drainage chamber 125 and the outlet 233 is connected with the circumference of the sump 120.

The bypass path 230 serves to directly supply the washing water from the dirt storage unit 179 to the sump 120 if the filter 194 is stopped up, thereby preventing the pressure inside the dirt chamber 170 from increasing and preventing washing performance from being deteriorated.

However, as the filter 194 is stopped up, the dirt remains in the washing water flown into the bypass path 230 without being filtered. Accordingly, to remove the dirt included in the washing water, the bypass path 230 further includes a bypass filter 235 between the inlet 231 and the outlet 233.

Preferably, the bypass path 230 includes a bending part P formed at a position higher than the filter 194 so that the washing water flows only if the filter 194 is stopped up.

If the filter 194 is not stopped up, the washing water flown into the drainage chamber 125 through the connection pipe 1751 does not have any pressure that can reach the bending part P of the bypass path 230, whereby the washing water flows into the dirt storage unit 179 through the collection pipe 178.

However, if the filter 194 is stopped up, since the inner pressure of the dirt storage unit 179 increases, the washing water flows into the sump 120 through the bending part P of the bypass path 230.

Accordingly, according to the dishwasher of the present invention, the washing water does not flow to the filtering unit 190 if the filter 194 is stopped up but is bypassed to the water storage unit 128, whereby deformation of the filter 194 can be prevented from occurring.

Since the bypass filter 235 is provided between the inlet 231 and the outlet 233 of the bypass path 230, the bypass filter 235 filters the dirt included in the washing water which flows in the bypass path 230, if the filter 194 is stopped up.

The dirt filtered by the bypass filter 235 flows into the drainage chamber 125 through the bypass inlet 231 together with the washing water remaining in the bypass path 230 if the drainage pump 130 is driven, and is drained out through the drainage hole 131.

In this case, it is preferable that the bypass filter 235 is provided at a position lower than the bending part P of the bypass path. This is because that the dirt may not be drained easily through the drainage pump 130 if the bypass filter 235 is provided between the bending part P and the outlet 233 of the bypass path.

Meanwhile, the bypass filter 235 may be provided at the inlet 231 of the bypass path 230.

In other words, if the filter 194 is stopped up, the washing water may flow into the bypass path 230 after being filtered by a bypass filter 235 provided at the inlet 231 of the bypass path.

Accordingly, the dirt filtered by the bypass filter 235' remains in the drainage chamber 125 and is drained out when the drainage pump 130 is driven.

Preferably, the inlet 231 of the bypass path 230 is protruded at a predetermined height from the bottom of the drainage chamber 125. This is because that the dirt precipitated in the drainage chamber 125 may flow into the bypass path 230 or may be collected on the inlet 231 of the bypass path if the inlet 231 of the bypass path 230 is provided on the bottom of the drainage chamber 125.

Also, the drainage chamber 125 can include a path bending unit 300 on the inlet 231 of the bypass path 230 so that the dirt included in the washing water flown into the connection pipe 1751 is prevented from directly flowing into the inlet 231 of the bypass path.

The path bending unit 300 is protruded between the end of the connection pipe 1751 and the bypass path 231 and allows the washing water flowing from the connection pipe 1751 to flow with slope toward the drainage pump 130.

Accordingly, it is expected that the dirt included in the washing water is precipitated in the front of the drainage pump 130 in accordance with inertia of a flowing direction of the washing water.

However, it is to be understood that the connection pipe 1751 may be bent to serve as the path bending unit 300.

According to another embodiment of the dishwasher of the present invention, the inlet 231 of the bypass path is provided at a side A of the drainage chamber 125. In this case, the inlet 231 of the bypass path may be spaced apart from the bottom of the drainage chamber 125 at a predetermined height.

Preferably, the aforementioned path bending unit 300 or bent connection pipe P is provided so that the dirt is not precipitated in the inlet 231 of the bypass path 230.

It will be apparent to those skilled in the art that the present invention can be embodied in other specific forms without departing from the spirit and essential characteristics of the invention. Thus, the above embodiments are to be considered in all respects as illustrative and not restrictive. The scope of the invention should be determined by reasonable interpretation of the appended claims and all change which comes within the equivalent scope of the invention are included in the scope of the invention.

What is claimed is:

1. A dishwasher, comprising:

a sump that stores washing water;

a drainage chamber provided at a side of the sump and linked with a drainage pump;

a dirt chamber including a main path that supplies the washing water supplied from the sump to a plurality of spray arms, a sub path that supplies some of the washing water supplied from the sump to the drainage chamber, a dirt storage device that stores the washing water passed through the drainage chamber, and a collection pipe that supplies the washing water of the drainage chamber to the dirt storage device;

a filter provided above the dirt storage device, that filters the washing water;

a connection pipe linked to an end of the sub path and located inside the drainage chamber; and a bypass path having an inlet and an outlet, wherein the inlet of the bypass path is connected with the drainage chamber and the outlet of the bypass path is connected with a circumference of the sump, wherein the bypass path includes a bending part formed at a position higher than the filter, and wherein a path bending device is provided between an outlet of the connection pipe and the inlet of the bypass path to allow dirt drained from the connection pipe to be precipitated away from the inlet of the bypass path.

2. The dishwasher of claim 1, wherein the inlet of the bypass path is provided on a bottom of the drainage chamber.

3. The dishwasher of claim 2, wherein the inlet of the bypass path protrudes from the bottom of the drainage chamber at a predetermined height.

4. The dishwasher of claim 1, wherein the connection pipe is bent to allow the drained dirt to be precipitated away from the inlet of the bypass path.

5. The dishwasher of claim 3, wherein the bypass path further includes a bypass filter that filters the washing water.

6. The dishwasher of claim 3, wherein the drainage pump is linked to the side of the sump.

7. The dishwasher of claim 1, wherein the inlet of the bypass path is provided at a sidewall of the drainage chamber.

8. The dishwasher of claim 7, wherein the inlet of the bypass path is spaced apart from a bottom of the drainage chamber at a predetermined height.

9. The dishwasher of claim 1, wherein the path bending device slopes toward the drainage pump.

10. The dishwasher of claim 7, wherein the bypass filter is provided at a position lower than the bending part of the bypass path.

11. The dishwasher of claim 7, wherein the bypass filter is provided at the input of the bypass path.

12. A dishwasher, comprising:

a sump that stores washing water;

a drainage chamber provided at a side of the sump and linked with a drainage pump;

a dirt chamber including a main path that supplies the washing water supplied from the sump to a plurality of spray arms, a sub path that supplies some of the washing water supplied from the sump to the drainage chamber, a dirt storage device that stores the washing water passed through the drainage chamber, and a collection pipe that supplies the washing water of the drainage chamber to the dirt storage device;

a filter provided above the dirt storage device;

a connection pipe linked to an end of the sub path and located inside the drainage chamber; and a bypass path having an inlet and an outlet, wherein the inlet of the bypass is connected with the drainage chamber and the outlet of the bypass is connected with a circumference of the sump, and wherein the connection pipe is bent to allow drained dirt to be precipitated away from the inlet of the bypass path.

13. The dishwasher of claim 12, wherein the connection pipe is bent toward the drainage pump.

14. The dishwasher of claim 12, wherein the bypass path further includes a bypass filter that filters the washing water.

15. The dishwasher of claim 14, wherein the bypass filter is provided at a position lower than a bending part of the bypass path.

16. The dishwasher of claim 15, wherein the bypass path includes a bending part formed at a position higher than the filter.

17. The dishwasher of claim 15, further comprising a connection pipe linked to an end of the sub path and located inside the drainage chamber.

18. The dishwasher of claim 16, wherein a path bending device provided between an outlet of the connection pipe and the inlet of the bypass path to allow dirt drained from the connection pipe to be precipitated away from the inlet of the bypass path.

19. A dishwasher, comprising:

a sump that stores washing water;

a drainage chamber provided at a side of the sump and linked with a drainage pump;

a dirt chamber including a main path that supplies the washing water supplied from the sump to a plurality of spray arms, a sub path that supplies some of the washing water supplied from the sump to the drainage chamber, a dirt storage device that stores the washing water passed through the drainage chamber, and a collection pipe that supplies the washing water of the drainage chamber to the dirt storage device;

a filter provided above the dirt storage device;

a bypass path having an inlet and an outlet, wherein the inlet of the bypass path is connected with the drainage chamber and the outlet of the bypass path is connected with a circumference of the sump, and wherein the inlet of the bypass path protrudes from a bottom of the drainage chamber to a predetermined height.

* * * * *